US007809151B2

(12) United States Patent
Van Halteren et al.

(10) Patent No.: US 7,809,151 B2
(45) Date of Patent: Oct. 5, 2010

(54) MICROPHONE ASSEMBLY COMPRISING MAGNETICALLY ACTIVATABLE ELEMENT FOR SIGNAL SWITCHING AND FIELD INDICATION

(75) Inventors: Aart Zeger Van Halteren, Hobrede (NL); Peter Salmi, Mound, MN (US)

(73) Assignees: Sonion Nederland, B.V., Amsterdam (NL); Starkey Laboratories, Inc., Eden Prairie, MN (US)

( * ) Notice: Subject to any disclaimer, the term of this patent is extended or adjusted under 35 U.S.C. 154(b) by 1242 days.

(21) Appl. No.: 11/171,702

(22) Filed: Jun. 30, 2005

(65) Prior Publication Data

US 2006/0018494 A1 Jan. 26, 2006

Related U.S. Application Data

(60) Provisional application No. 60/585,037, filed on Jul. 2, 2004.

(51) Int. Cl.
*H04R 9/08* (2006.01)

(52) U.S. Cl. ..... 381/355; 381/331; 381/315

(58) Field of Classification Search ..... 381/123, 381/125, 312–331, 355–369; 324/207.11–207.21; 335/205

See application file for complete search history.

(56) References Cited

U.S. PATENT DOCUMENTS

| | | | | |
|---|---|---|---|---|
| 4,467,145 | A | 8/1984 | Borstel | 381/329 |
| 5,101,435 | A * | 3/1992 | Carlson | 381/331 |
| 5,659,621 | A * | 8/1997 | Newton | 381/312 |
| 5,835,003 | A * | 11/1998 | Nickel et al. | 338/32 R |
| 5,994,898 | A * | 11/1999 | DiMarzio et al. | 324/244.1 |
| 6,157,727 | A | 12/2000 | Rueda | 381/312 |
| 6,633,645 | B2 * | 10/2003 | Bren et al. | 381/1 |
| 7,016,511 | B1 * | 3/2006 | Shennib | 381/315 |
| 7,043,035 | B2 * | 5/2006 | Rittersma et al. | 381/173 |
| 7,162,138 | B2 | 1/2007 | Ingman et al. | 702/65 |
| 7,162,381 | B2 * | 1/2007 | Boor et al. | 702/65 |
| 7,317,997 | B2 | 1/2008 | Boor et al. | 702/65 |
| 7,319,768 | B2 * | 1/2008 | van Oerle | 381/312 |
| 7,477,325 | B2 * | 1/2009 | Zhu et al. | 348/725 |
| 2003/0059073 | A1 | 3/2003 | Bren et al. | 381/312 |
| 2005/0012500 | A1 * | 1/2005 | Braun et al. | 324/207.24 |

FOREIGN PATENT DOCUMENTS

| | | |
|---|---|---|
| DE | 31 09 049 | 9/1982 |
| DE | 32 31 029 | 2/1984 |
| DE | 197 21 982 | 12/1998 |

OTHER PUBLICATIONS

Third-Party Submission under 37 C.F.R. §1.99 by Anthony G. Sitko, dated Feb. 20, 2008 (3 pages).

European Search Report, Application No. 05013779.3 dated Sep. 22, 2008 (3 pages).

* cited by examiner

*Primary Examiner*—Curtis Kuntz
*Assistant Examiner*—Ryan Robinson
(74) *Attorney, Agent, or Firm*—Nixon Peabody, LLP

(57) ABSTRACT

A microphone assembly comprising a transducer for receiving sound and outputting a corresponding control signal. The assembly also comprises means for detecting a magnetic field and outputting a signal relating to the field. A hearing aid comprising the assembly has a processor receiving the control signal and selecting between the microphone signal and a signal relating to the magnetic field, such as a signal received from a telephone hand set or a telecoil.

14 Claims, 2 Drawing Sheets

MICROPHONE ASSEMBLY COMPRISING MAGNETICALLY ACTIVATABLE ELEMENT FOR SIGNAL SWITCHING AND FIELD INDICATION

RELATED APPLICATION

This application claims the benefit of U.S. Provisional Application No. 60/585,037, entitled "Microphone Assembly Comprising Magnetically Activated Switch For Signal And Field Indication," filed Jul. 2, 2004.

FIELD OF THE INVENTION

The present invention relates to a microphone assembly comprising a magnetically activatable element arranged inside the microphone housing so as to allow automatic signal source selection between two or more signal sources. A magnetically activatable element arrangement is adapted to detect a presence of a static magnetic field from, e.g., a telephone handset loudspeaker and provide a field indicator control signal associated with the presence or absence of the telephone handset.

BACKGROUND OF THE INVENTION

It is well-known in the art to incorporate a reed-relay on a hearing prosthesis circuit board and be operable to switch between a telecoil input signal and a microphone input signal depending upon a field strength value of an externally applied static magnetic field. The externally applied static magnetic field has in the prior art been generated by manual user intervention through use of a hand-held rod-shaped magnet actuator, or by a static magnetic field radiated by a loudspeaker magnet of a telephone handset when the latter approaches the hearing prosthesis.

U.S. Patent Application Publication No. 2003/0059073 discloses a hearing aid circuit that comprises a magnetically activated switch in the form of a reed-relay adapted to switch between a microphone and a telecoil input signal. The switching circuitry and the associated reed relay is a relatively complex construction utilizing a number of bipolar transistors and other circuitry and arranged on a circuit board of the hearing aid.

Several drawbacks are associated with these prior art techniques. The inclusion of, for example, a reed-relay and wiring associated therewith within the hearing prosthesis leads to a significant occupation of printed circuit board area or hybrid substrate area in the hearing aid. This is particularly troublesome for small hearing aids such as ITC and CIC-type of hearing aids which are adapted for positioning partly or entirely within the user's ear canal and which therefore must posses very small dimensions.

By routing the switchable input signals through the relay switch itself, it is impossible to dispense with or overrule the automatic switching between input signal sources when a static magnetic field of some predetermined threshold value is applied to the reed relay. The switching logic is integral to the magnetic sensing mechanism as such and thus unable to cooperate with, e.g., a hearing aid signal processor, such as a microprocessor or digital signal processor, to determine whether input signal source switching is needed.

SUMMARY OF THE INVENTION

It is an object of the present invention to circumvent the above-mentioned disadvantages of the prior art by, in a first aspect of the invention, providing a microphone assembly comprising a microphone housing with a magnetically activated element adapted to provide a control signal indicative of a magnetic field acting thereon. This element may be a magnetically resistive element arranged inside the microphone housing, Hall sensor or a magnetically activatable switch, which may be a reed relay. The control signal may relate merely to the presence of a magnetic field having a strength exceeding a predetermined threshold, or the signal may relate to a strength of the field. The microphone assembly also comprises a transducer element adapted to provide a microphone signal in response to incoming sound.

According to a first embodiment of the invention, the microphone assembly comprises a first externally accessible terminal for receiving a signal from a first external input signal source, such as a telecoil signal or a direct audio signal, and a second externally accessible terminal providing an output signal. The magnetically activated element is operatively coupled to the microphone signal, the first input signal source and the second externally accessible terminal on respective element terminals, and is operative to selectively route the microphone signal or the first input signal source to the second externally accessible terminal based on a presence or even a field strength of a static magnetic field applied to the magnetically activated element. The magnetically activated element may be responsive to whether the field strength of the magnetic field is above or below a predetermined threshold value. The threshold value may advantageously be selected to a value between 1 and 5 mT such as 2-3 mT. The switching between states at the threshold value may advantageously comprise a predetermined amount of hysteresis to avoid rapid switch state changes for field strength values close to the threshold value.

Alternatively, the element may output a signal relating to the strength of the magnetic field. Then, another element, such as a processor, may be taking the decision as to which signal to choose.

The magnetically activated element may conveniently be disposed adjacent to a microphone preamplifier on a common ceramic carrier substrate within the microphone housing to take advantage of already existing electrical routing and mechanical support capabilities. The microphone housing may comprise respective externally accessible terminals for power supply and ground.

While a reed relay or reed switch is highly advantageous in the present invention, other magnetically sensitive relay types may also be used such as relays based on magnetically sensitive semiconductor materials or a magnetoresistive sensor, such as the Giant Magnetoresistance (GMR) sensor from NVE.

According to a second embodiment of the invention, the microphone assembly comprises a magnetically activatable element having first and second terminals operatively connected to a first and second reference voltage, respectively, and an output terminal operative to selectively route the first or second reference voltage to the output terminal based on a field strength of a static magnetic field applied to the magnetically activated element. The output terminal of the magnetically activated element may be routed to an externally accessible terminal that accordingly can provide a control signal indicative of the presence or absence of the static magnetic field. The control signal may be a direct representation of the first and second reference voltages or a signal derived from any of these. Therefore the control signal may comprise a logic or binary signal, said logic signal having states represented by respective voltage or current levels or the control signal may comprise a DC level shift or AC signal modulation change to indicate the presence of the static magnetic field.

A particularly interesting embodiment is one in which the assembly further comprises at least one magnetically conducting element having a tapering shape from a narrow part to a wider part, the narrow part abutting or being positioned close to the magnetically activatable element. This tapering part may be used for actually amplifying the magnetic field at the sensor/switching element in order to better determine or sense weak magnetic fields. In popular terms, this tapering or wedge-shaped element will collect more field lines thereby amplifying the field transmitted to the element. Naturally, more than one such element may be used in order to further increase the magnetic field at the sensor/switch.

An alternative would be to encapsulate the magnetically activatable element in a material reducing or weakening magnetic fields so that strong magnetic fields do not harm or overload the sensor/switch.

In yet another embodiment, the magnetically activatable element is adapted to sense a magnetic field along a predetermined direction, the assembly further comprising a sensor, such as a telecoil or the like, for sensing a magnetic field and output a signal relating to the magnetic field. This sensor comprises a magnetically conductive material, which may be used to enhance or amplify the magnetic field at the magnetically activatable element, if positioned at least substantially in the predetermined direction. Thus, this sensor now fulfils two objectives.

Naturally, the sensor or magnetically conducting element (s) may be provided in the microphone housing or outside it.

A second aspect of the invention relates to a hearing aid or prosthesis, such as a BTE, ITE, ITC or CIC hearing aid, comprising a microphone assembly as described above, the hearing aid further comprising:

an element adapted to determine a varying magnetic field and provide a second signal corresponding to a variation of the magnetic field, and a processing unit adapted to:

receive the transducer signal, the control signal and the second signal, on the basis of the control signal, select the transducer signal or the second signal, and output a signal relating to the selected signal.

The control signal on an externally accessible terminal of the microphone assembly may be operatively coupled to an input port of the hearing aid processor. The input port may comprise a logic input port responsive to, for example, whether a VDD (battery supply voltage) or GND level is present at the input port, wherein VDD and GND levels are representative of the first or second reference voltages, respectively. The input port may instead, or in addition, comprise a DC sensing A/D converter capable of reading a particular value of the voltage or current at the input port. Both of these solutions are advantageous and preferred embodiments of the present invention since existing hearing aid signal processors support the required processor functions and have compatible processor input ports.

In another embodiment, the hearing aid further comprises an element operable by a user, the processing unit being adapted to select the transducer signal or the second signal on the basis of whether the element is operated by the user. This element may be, for example, a push button, a rotatable element, a proximity sensor or a movement sensor. Thus, the user may her/himself change between the two inputs if desired or may switch away from that relating to the magnetic field even though the field is present (or may switch to the signal relating to the magnetic field even though it is too weak to itself activate the switching).

The microphone assembly may comprise a silicon condenser microphone with some or all parts fabricated by MEMS techniques in silicon. The microphone assembly may comprise an internally disposed A/D converter together with a preamplifier on a common substrate and adapted to sample and digitise a preamplifer output signal and provide a digitally coded output signal as the output signal.

BRIEF DESCRIPTION OF THE DRAWINGS

The foregoing and other advantages of the invention will become apparent upon reading the following detailed description and upon reference to the drawings.

Figure 1:
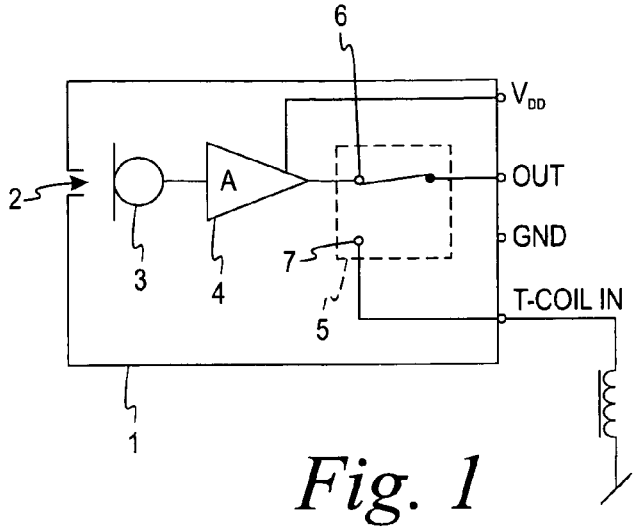
FIG. 1 shows a simplified schematic of a first embodiment of a microphone assembly according to the invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

FIG. 1 shows a miniature microphone assembly suitable for use in hearing aids and that comprises an electret transducer element 3 disposed inside a microphone housing 1. The microphone housing 1 has a sound inlet port 2 for receipt of incoming sound signals and four externally accessible electrical terminals VDD, OUT, T-COIL IN and GND. A microphone preamplifier 4 is operatively coupled to the electret transducer element 3 to amplify and/or buffer signals therefrom. A micro reed relay 5 comprises first and second input terminals connected to a preamplifier output 6 and T-coil input 7, respectively and operative to selectively connect one of the preamplifier output 6 and T-coil input 7 to external output terminal OUT of the microphone assembly depending on whether a magnetic field strength acting on the micro reed relay is above or below a predetermined threshold. The preamplifier 4 and the micro reed relay 5 are mounted on common ceramic substrate (not shown) disposed inside the microphone housing 1. The microphone housing 1 may comprises a stainless steel and or polymeric material. The preamplifier 1 may additionally comprise a dedicated telecoil amplifier adapted to amplify the T-Coil In signal before it is conveyed to the reed relay 5 to allow some predetermined target level matching of microphone and telecoil signal.

Figure 2:
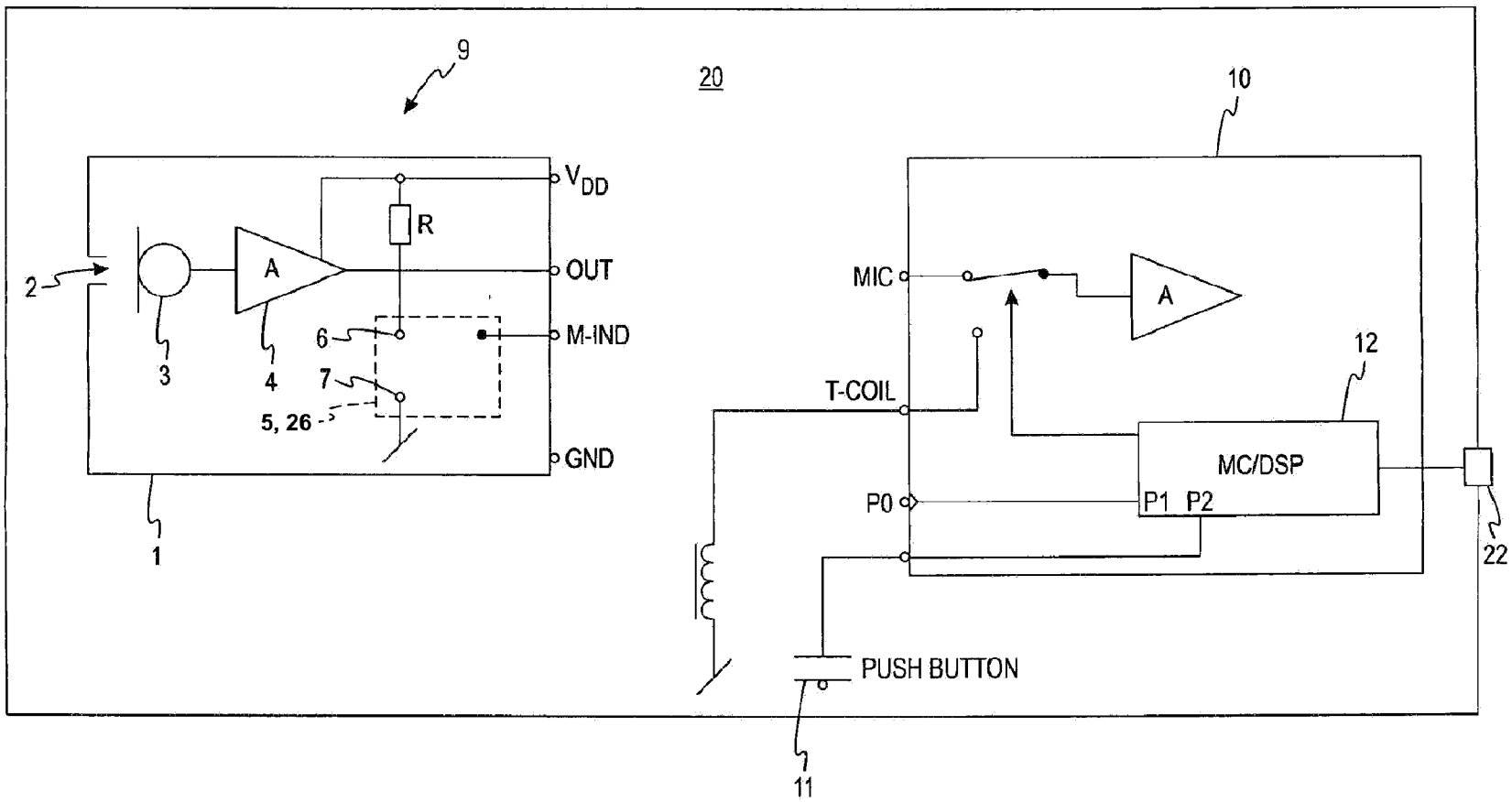
FIG. 2 shows a simplified schematic of a second embodiment of a microphone assembly according to the invention.

FIG. 2 shows a second embodiment of a miniature microphone assembly 9 together with a hearing aid signal processor circuit 10 connected to a user actuable program selector button 11 in schematic form. Miniature microphone assembly 9 comprises an electret transducer element 3 disposed inside a microphone housing 1. The microphone housing 1 has a sound inlet port 2 for receiving incoming sound signals and four externally accessible electrical terminals VDD, OUT, M-IND and GND. A micro reed relay 5 or other magnetically sensitive element 26 (e.g. a relay based on magnetically sensitive semiconductor materials or a magnetoresistive sensor) is disposed within the housing 1 and comprises first and second input terminals 6,7 connected to a microphone assembly power supply voltage VDD through pull-up resistor R and GND, respectively. The commercially available micro reed relay from Asulab S.A., designated MR-14 MicroReed, is suitable for use in a specific embodiment as the micro reed relay 5. The micro reed relay 5 or other magnetically sensitive element 26 is operative to selectively connect one of the VDD and GND signal to external output terminal M-IND of the microphone assembly depending on whether a magnetic field strength acting on the micro reed relay is above or below a predetermined threshold value. Terminal M-IND is accordingly capable of providing a control signal indicative of whether the magnetic field strength acting on the micro reed relay is above or below a predetermined threshold value, and by directly coupling the input terminals of the micro reed relay 5 or other magnetically sensitive element 26 to voltage levels VDD and GND, respectively, the control signal M-IND provides logic levels that may be directly compatible with logic levels of a hearing aid signal processor coupled to the microphone assembly and also supplied by voltage VDD or a supply voltage derived therefrom. Control signal M-IND may be connected to processor input port P0 that may be level sensitive or edge sensitive and capable of sampling a logic state of the M-IND signal. User actuable program selector button 11 is operative to switch between a T-Coil input signal and a microphone input signal provided on external terminal OUT of the microphone housing 1 under control of the processor or DSP 12 of hearing aid processor 10.

A significant advantage of the present miniature microphone assembly 9 embodiment is that the provision of a control signal M-IND to the hearing aid processor 10 makes the processor 10 the master of the signal source switching scheme and allows it to be programmed to overrule or support the automatic switching between input signal sources when a static magnetic field of some predetermined strength is applied to the reed relay. Furthermore, if the static magnetic field strength of a telephone handset for some reason falls below the predetermined field strength, i.e. switch threshold value, so that the automatic switching does not function, the hearing aid user has the choice of manually intervening to switch signal source by actuating the program selector button 11.

FIG. 2 also illustrates the outline of a casing 20 of a hearing aid comprising the assembly 9, processor 10, the telecoil and the button 11. The button 11, naturally, is positioned so as to be engageable by the user.

Also illustrated is a speaker 22, which is fed by the processor 10 and which outputs the sound for the user.

Figure 3:
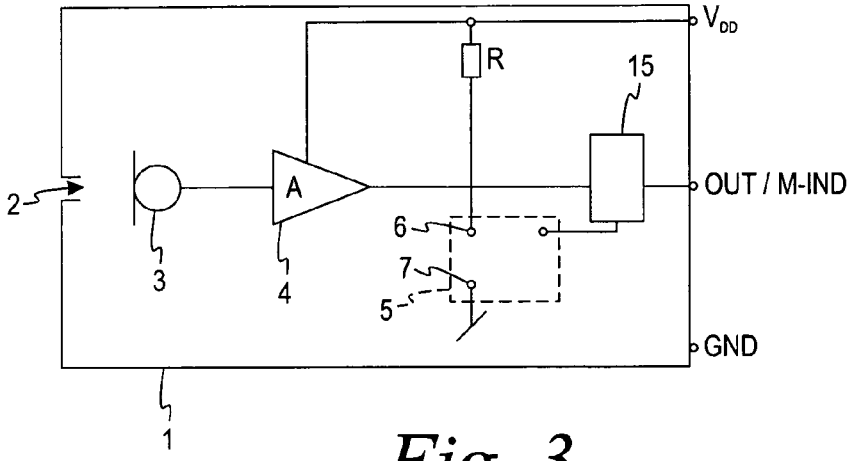
FIG. 3 shows a simplified schematic of a third embodiment of a microphone assembly according to the invention.

FIG. 3 shows a variant of the miniature microphone assembly embodiment disclosed in FIG. 2. This embodiment of the invention comprises a common output and control signal terminal, OUT/M-IND, on the microphone housing 1 while other features correspond to the previous embodiment. The use of a common output and control signal terminal saves an external terminal of the microphone assembly while maintaining a simple interface to existing hearing aid processors, said interface being compatible with existing 3-terminal subminiature microphones. A DC level shifter 15 is operatively connected to the output of the micro reed relay 5, which has input terminals connected to voltage levels VDD and GND, and to the preamplifier output signal. The level shifter 15 is adapted to change a DC voltage level of the output terminal between first and second predetermined levels depending on the voltage of the output of the micro reed relay 5. Thereby, the DC voltage level of the OUT/M-IND becomes indicative of whether the magnetic field strength acting on the micro reed relay is above or below the predetermined threshold value. A difference between the between first and second predetermined DC levels may advantageously be selected to correspond to a voltage drop of a forward biased silicon diode such as a voltage difference between 0.4 and 0.7 Volt, but other values may be used as well. A significant advantage of this embodiment is that the DC level provided on the OUT/M-IND terminal can be sensed by a standard sense port input of a hearing aid processor, said sense port being operatively coupled to a DC responsive sampling A/D converter integrated on the hearing aid processor 10 (FIG. 2). The microphone signal also present on the OUT/M-IND terminal is routed to microphone input, MIC, of the hearing aid processor 10. The hearing aid processor 10 can by suitable signal processing manage adverse effects of switching the DC level on OUT/M-IND terminal by, for example, attenuating transients or temporarily mute the microphone input signal until the DC level is stable.

The microphone assembly 9 may comprise a silicon condenser microphone with some or all parts fabricated according to MEMS techniques.

The microphone assembly 9 may comprise an internal A/D converter adapted to sample and digitize the preamplifier output signal and provide a digitally coded output signal. A protocol of the digitally coded output signal may be adapted so as to comprise logic values of the M-IND signal indicative of the magnetic field strength acting on the micro reed relay and thereby maintain the utilisation of a common output signal terminal for the OUT/M-IND signal on the microphone housing.

Figure 4:
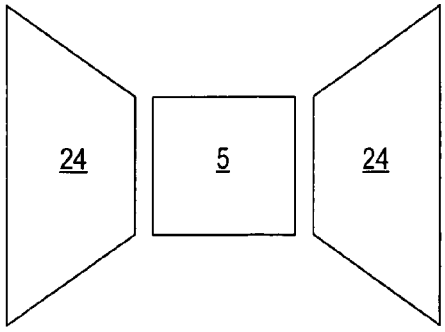
FIG. 4 illustrates the use of magnetic field amplifying wedges.

FIG. 4 illustrates a manner of increasing the sensitivity of the magnetically activatable element 5. This manner is using two wedge-shaped or fan-shaped elements 24 adapted to receive magnetic field lines and concentrate these in the element 5. This, naturally, increases or amplifies the magnetic field at the element 5, whereby this is made more sensitive to the field. The material of the elements 24 may be any magnetically conducting material, and the material 24 is preferably close to—or even may be touching—the element 5. Preferably two such wedges 24 are used and are positioned opposite each other along an axis in which the element 5 is sensitive to a magnetic field. Naturally, several elements 5, optionally including each their wedges 24, may be used for determining magnetic fields along a plurality of directions (such as directions defined by the extent of the wedges 24.

The telecoil may comprise a magnetically conductive element which also may be used instead of the above wedge(s). This material, when positioned at the correct position or direction in relation to the direction of sensitivity of the element 5, will also function to enhance/concentrate/amplify the magnetic field at the element 5.

Naturally, the telecoil or wedges 24 may be provided in the microphone housing with the element 5 or outside the housing.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

The invention claimed is:

1. A microphone assembly comprising:

a microphone housing having a sound inlet port;

disposed inside the housing, a transducer element adapted to provide a transducer signal in response to incoming sound received at the sound inlet port;

a magnetically activated element disposed inside the microphone housing;

the housing including a first externally accessible terminal for receiving a signal from a first external input signal source; and the housing including a second externally accessible terminal providing an output signal, the magnetically activated element being operatively coupled to the transducer signal, to the first input signal source via the first externally accessible terminal, and to the second externally accessible terminal, and being operative to selectively route the transducer signal or the input from the first external input signal source as the output signal to the second externally accessible terminal based on a presence or a field strength of a static magnetic field applied to the magnetically activated element.

2. A microphone assembly according to claim 1, wherein the magnetically activated element is a magnetically activated switch.

3. A microphone assembly according to claim 1, wherein the magnetically activated element is adapted to detect the magnetic field during a predetermined period of time.

4. A microphone assembly according to claim 1, further comprising at least one magnetically conducting element having a tapering shape from a narrow part to a wider part, the narrow part opposing the magnetically activatable element.

5. A microphone assembly according to claim 3, further comprising at least one magnetically conducting element having a tapering shape from a narrow part to a wider part, the narrow part opposing the magnetically activatable element.

6. A microphone assembly according to claim 1, wherein the magnetically activatable element is adapted to sense a magnetic field along a predetermined direction, the assembly further comprising a sensor for sensing a magnetic field and outputting a signal relating to the magnetic field, the sensor comprising a magnetic material, the magnetic material being positioned, relative to the magnetically activatable element, at least substantially in the predetermined direction.

7. A microphone assembly according to claim 2, wherein the magnetically activated element is adapted to sense a magnetic field along a predetermined direction, the assembly further comprising a sensor for sensing a magnetic field and outputting a signal relating to the magnetic field, the sensor comprising a magnetic material, the magnetic material being positioned, relative to the magnetically activatable element, at least substantially in the predetermined direction.

8. A microphone assembly according to claim 3, wherein the magnetically activated element is adapted to sense a magnetic field along a predetermined direction, the assembly further comprising a sensor for sensing a magnetic field and outputting a signal relating to the magnetic field, the sensor comprising a magnetic material, the magnetic material being positioned, relative to the magnetically activatable element, at least substantially in the predetermined direction.

9. A microphone assembly according to claim 4, wherein the magnetically activated element is adapted to sense a magnetic field along a predetermined direction, the assembly further comprising a sensor for sensing a magnetic field and outputting a signal relating to the magnetic field, the sensor comprising a magnetic material, the magnetic material being positioned, relative to the magnetically activatable element, at least substantially in the predetermined direction.

10. A microphone assembly according to claim 5, wherein the magnetically activated element is adapted to sense a magnetic field along a predetermined direction, the assembly further comprising a sensor for sensing a magnetic field and outputting a signal relating to the magnetic field, the sensor comprising a magnetic material, the magnetic material being positioned, relative to the magnetically activatable element, at least substantially in the predetermined direction.

11. A hearing aid comprising a microphone assembly according to claim 1, the hearing aid further comprising: an element adapted to determine a varying magnetic field and provide a second signal corresponding to a variation of the varying magnetic field, and a processing unit adapted to: receive the transducer signal and the second signal, on the basis of the presence or the field strength of the static magnetic field applied to the magnetically activated element, select the transducer signal or the second signal, and output a signal relating to the selected signal.

12. A hearing aid according to claim 11, further comprising an operable element operable by a user, the processing unit being adapted to select the transducer signal or the second signal on the basis of whether the operable element is operated by the user.

13. A microphone assembly comprising:

a microphone housing having a sound inlet port and a transducer element disposed in the housing and adapted to provide a transducer signal in response to incoming sound received at the sound inlet port; and a magnetically sensitive semiconductor material disposed inside the microphone housing and adapted to provide a control signal indicative of a detected magnetic field, the housing including a first externally accessible terminal for receiving a signal from a first external input signal source, the housing further including a second externally accessible terminal providing an output signal, the magnetically sensitive semiconductor material being operative to selectively route the transducer signal or the signal from the first external input signal source as the output signal to the second externally accessible terminal based on a presence or a field strength of a static magnetic field applied to the magnetically sensitive semiconductor material.

14. A microphone assembly according to claim 13, wherein the magnetically sensitive semiconductor material comprises a giant magnetoresistance sensor.

* * * * *